United States Patent [19]

Jackson

[11] Patent Number: 4,583,385

[45] Date of Patent: Apr. 22, 1986

[54] FLAT DIE THREAD ROLLER

[75] Inventor: Warren M. Jackson, Rockford, Ill.

[73] Assignee: Warren M. Jackson, Inc., Rockford, Ill.

[21] Appl. No.: 551,476

[22] Filed: Nov. 14, 1983

[51] Int. Cl.[4] ..... B21H 3/06

[52] U.S. Cl. ..... 72/90

[58] Field of Search ..... 72/90, 88, 473, 482; 403/409, 408, 388

[56] References Cited

U.S. PATENT DOCUMENTS

| | | | |
|---|---|---|---|
| 389,168 | 9/1888 | Rogers | 72/88 |
| 470,805 | 3/1892 | Jones | 72/90 |
| 503,393 | 8/1893 | Vollmer | 72/90 |
| 550,550 | 11/1895 | Winssinger | 72/90 |
| 1,254,176 | 1/1918 | Thorsell | 72/90 |
| 2,967,444 | 1/1961 | Hallberg et al. | 72/90 |
| 3,229,791 | 1/1966 | Soman | 403/409 |
| 3,726,118 | 4/1973 | van de Meerendonk | 72/90 |
| 3,926,026 | 12/1975 | Jackson | 72/90 |
| 4,210,212 | 7/1980 | Jackson et al. | 403/409 |
| 4,229,966 | 10/1980 | Jackson | 72/469 |

FOREIGN PATENT DOCUMENTS

| | | | |
|---|---|---|---|
| 254488 | 5/1967 | Austria | 403/388 |
| 2206684 | 12/1981 | Fed. Rep. of Germany | 403/409 |

*Primary Examiner*—Daniel C. Crane

*Attorney, Agent, or Firm*—Leydig, Voit & Mayer, Ltd.

[57] ABSTRACT

The stationary die of a flat die thread rolling machine is supported on a series of stacked members which may be automatically unclamped, automatically adjusted and then automatically re-clamped to hold the stationary die in a precisely adjusted position relative to a reciprocating die. Fastener blanks from a supply hopper are fed to the dies along a set of parallel rails and are captivated by an upper hold-down rail, there being means for automatically and simultaneously adjusting the elevation of the hopper and the parallel rails and there further being means for independently adjusting the angle and elevation of the hold-down rail. Adjacent blanks in the parallel rails are separated from one another by a catcher which enables a pusher to insert the blanks between the dies in a smooth and trouble-free manner. A die holder for the stationary die is precisely located and locked in the machine but may be easily removed from the machine to facilitate easy and precise installation of the stationary die in the holder.

4 Claims, 20 Drawing Figures

FLAT DIE THREAD ROLLER

BACKGROUND OF THE INVENTION

This invention relates to a thread rolling machine of the type in which a movable die is reciprocated back and forth relative to a stationary die in order to form threads on the shanks of fastener blanks which are fed successively between the dies. The blanks usually are stored in a supply hopper and are fed from the hopper to the dies along a track defined by a pair of parallel rails, the blanks being held in the track by an upper hold-down rail spaced above the parallel rails. When each blank reaches an injection position adjacent the dies, a pusher feeds the blank between the dies.

A machine of this type is capable of forming threads on many different types and sizes of blanks and thus is often changed over at frequent intervals to accommodate different blanks. Such a changeover not only may involve changing the dies but also may require several set up adjustments to the position of the dies, the parallel track rails, the hold-down rail and the hopper. Jackson United States Patent 3,926,026 discloses a versatile thread rolling machine in which the changeover is simplified by virtue of the stationary die being carried on a series of stacked members which are adjustable relative to each other to allow precise adjustment of the stationary die.

SUMMARY OF THE INVENTION

The general aim of the present invention is to provide a new and improved thread rolling machine of the foregoing general type which is more completely automated than prior machines so that the various set up adjustments may be made quicker and easier than has been possible heretofore.

An important object of the invention is to provide a machine in which the stack of members carrying the stationary die may be automatically unclamped from one another, preferably automatically adjusted to reposition the stationary die and then automatically reclamped to hold the stationary die in the newly adjusted position.

Another object is to effect automatic adjustment of the elevation of the parallel rails and, at the same time, to automatically adjust the supply hopper in unison with the rails so as to always maintain a fixed elevational relationship between the hopper and the rails.

A more detailed object is to provide a machine in which a unique drive mechanism effects up and down adjustment of the hopper and the parallel rails while enabling the rails to be adjusted laterally relative to one another.

A further object of the invention is to provide a machine in which both the elevation and angle of the upper hold-down rail may be adjusted with the two adjustments being completely independent of one another so as to eliminate the need for multiple trial-and-error adjustments in setting the elevation and angle of the hold-down rail.

Still another object of the invention is to provide a machine in which a novel catcher moves in timed relation with the pusher and separates adjacent fastener blanks in the track so as to enable the pusher to insert the blanks between the dies in a smooth and trouble-free manner.

The invention also resides in the provision of a unique holder for the stationary die, the holder being characterized by its ability to be accurately located in but easily removed from the machine so as to simplify the task of changing the stationary die and to enable easy installation of the die in a precise position in the holder.

These and other objects and advantages of the invention will become more apparent from the following detailed description when taken in conjunction with the accompanying drawings.

DETAILED DESCRIPTION OF THE PREFERRED EMBODIMENT

Figure 1:
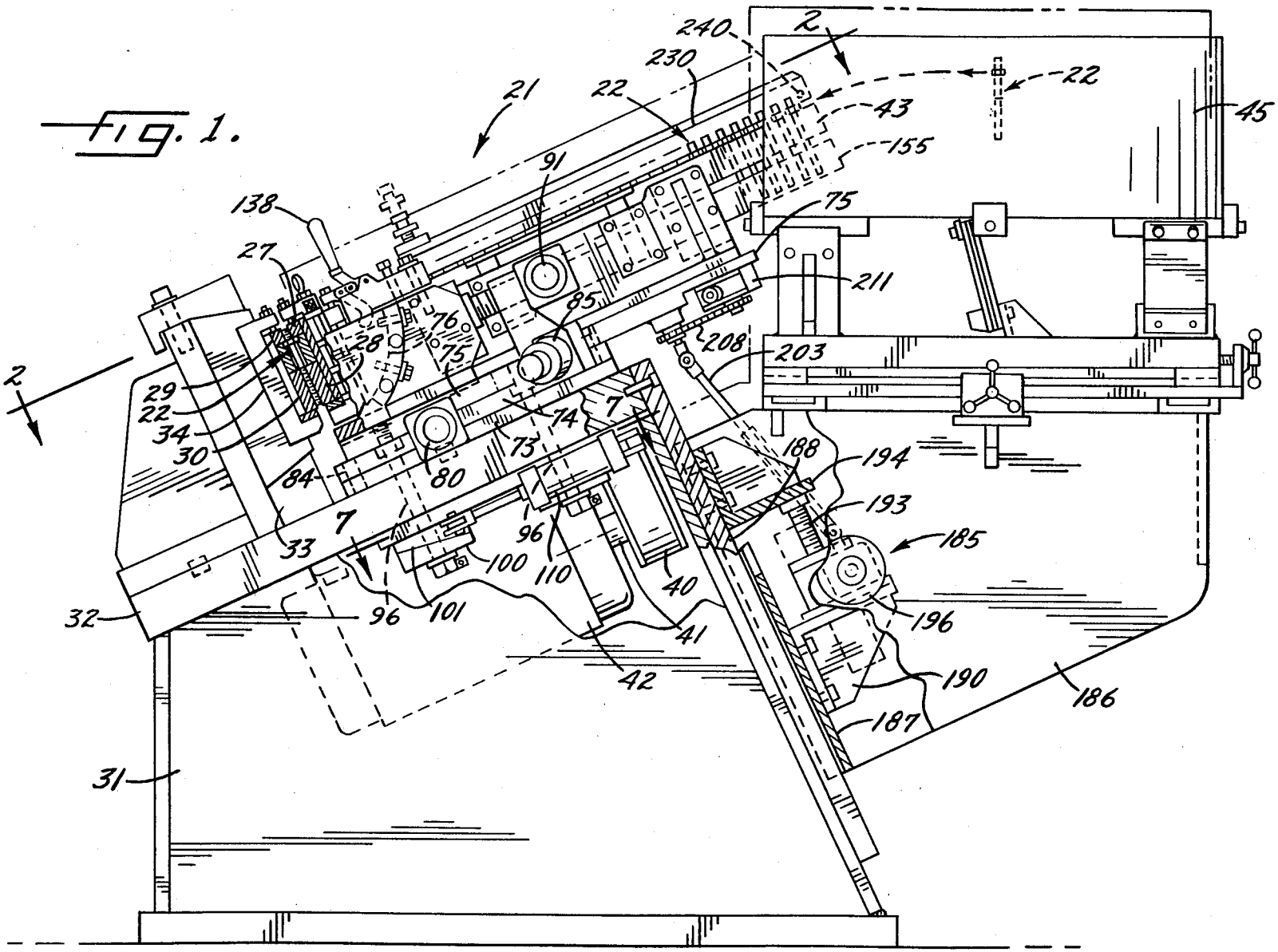
FIG. 1 is a fragmentary side elevational view of a new and improved thread rolling machine incorporating the unique features of the present invention.

As shown in the drawings for purposes of illustration, the invention is embodied in a flat die thread rolling machine 21 for forming threads on generally cylindrical blanks 22 which ultimately become threaded fasteners. The blanks may take various forms. The particular blank which has been illustrated and which is shown most clearly in FIGS. 9 and 14 comprises a lower shank portion 23, an enlarged diameter intermediate portion 24, a hexagonal wrenching collar 25 and an upper shank portion 26 having a diameter substantially equal to that of the intermediate portion. In this instance, the machine 21 is adapted to form threads on the two shank portions 23 and 26. The blanks 22 are fed one at a time between a set of upper and lower stationary dies 27 and 28 (FIG. 9) and a set of upper and lower movable dies 29 and 30 with the threads being formed as the movable dies reciprocate past the stationary dies to roll the blank along and between the opposing faces of the two sets of dies.

Figure 2:
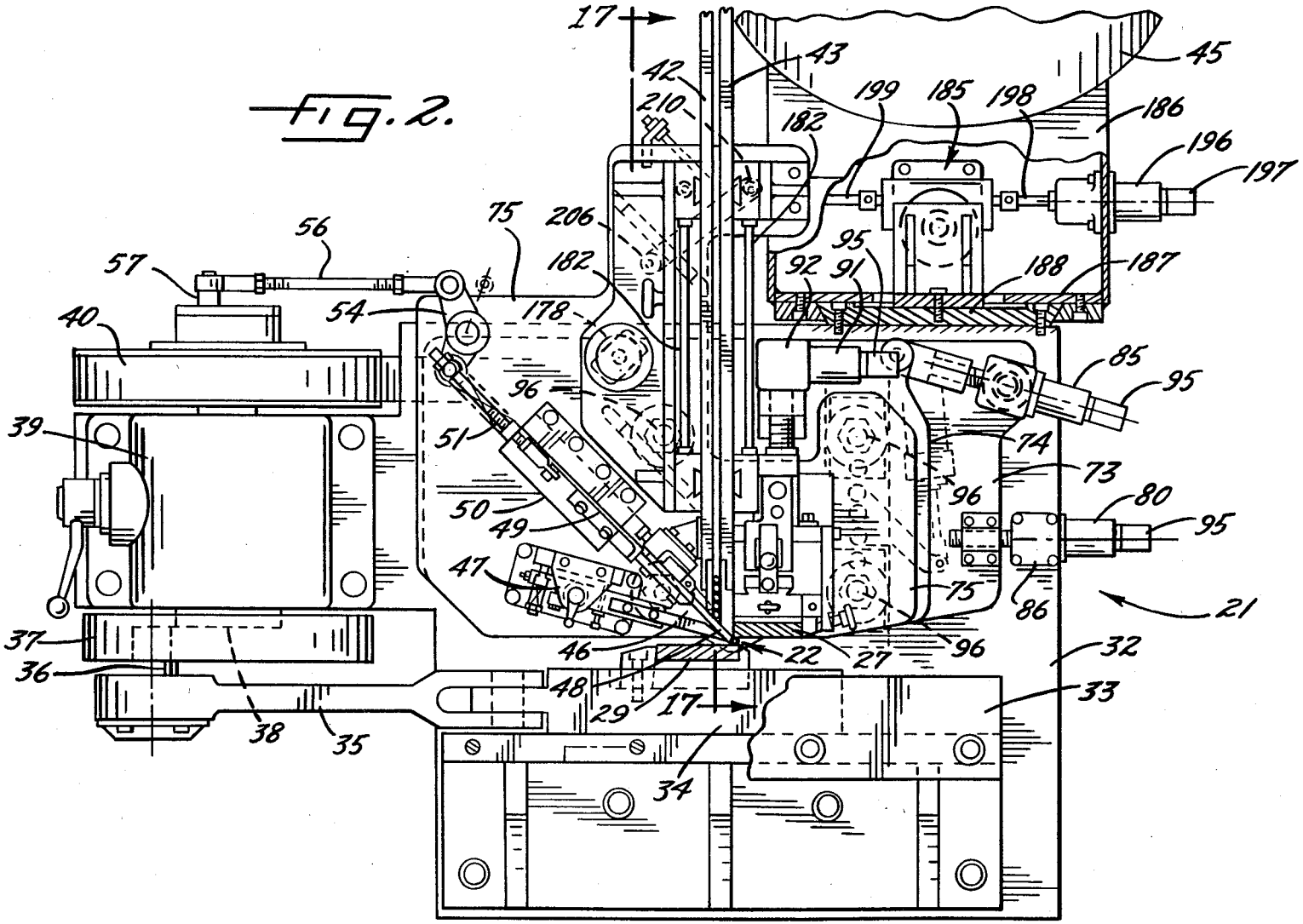
FIG. 2 is a view of the machine taken along the line 2—2 of FIG. 1.

More specifically, the machine 21 comprises a boxlike support or base 31 (FIG. 1) upon which is mounted a flat base plate 32, the base plate being inclined downwardly and forwardly at an angle of about thirty degrees. The stationary dies 27 and 28 are normally supported in a fixed position relative to the base plate 32 while the movable dies 29 and 30 are supported for back and forth reciprocation relative to the stationary dies by a guide shoe 33 (FIGS. 2 and 9) which is mounted on the base plate and which receives a sliding die holder 34 within which the movable dies are clamped. To reciprocate the movable dies, a connecting rod 35 (FIG. 2) is pivotally secured at one end to the die holder 34 and at its other end to an eccentric 36 which projects axially from a flywheel 37. The latter is keyed to one end of the shaft 38 of a speed reducer 39 which is power-rotated by a belt 40 extending between the other end of the shaft and the drive shaft 41 (FIG. 1) of a motor 42 housed within the base 31. When the movable dies 29 and 30 are at one extreme end of their stroke, their leading edges are located adjacent the leading edges of the fixed dies 27 and 28 in a position where a fastener blank 22 may be fed between the fixed and movable dies (see FIG. 4). Thereafter, the movable die is shifted to the right and causes the blank to roll between the dies to form the threads. As the movable dies reach the other extreme end of their stroke, the newly threaded fastener falls out of the dies and into a collecting hopper (not shown).

To deliver the blanks 22 between the dies 27, 28 and 29, 30, a pair of parallel rails 42 and 43 (FIG. 4) form a slotted track 44 which extends rearwardly from the dies to a vibratory hopper or bowl 45 located at the rear of the base 31. Blanks 22 fed from the bowl gravitate down the rails to an injection position (FIG. 6) adjacent the dies and are stopped by a gate 46 which extends across the exit ends of the rails. The gate is pivotally mounted on a supporting block 47 and is urged by a spring (not shown) to swing against the end of the rail 43 and hold the leading blank 22 in the track 44 in the injection position shown in FIG. 6.

Each time the movable dies 29 and 30 are retracted, a pusher or feed finger 48 (FIG. 4) engages the blank 22 in the injection position and pushes the blank past the pivoted escapement gate 46 and into the gap between the stationary and movable dies, the finger moving past the next blank in the track 44 and preventing that blank from moving out of the track and into the injection position. The feed finger is carried on one end of a slide 49 (FIG. 3) which is mounted for reciprocation in a guideway 50. A link 51 is pivotally connected at 52 to the other end of the slide 49 and is slidably received by an ear 53 upstanding from a bellcrank 54 which is pivoted at 55. The bellcrank is adaped to be oscillated about the pivot 55 by a link 56 connected to an eccentric 57 (FIG. 2) located on the end of the shaft 38 opposite the flywheel 37.

Figure 6:
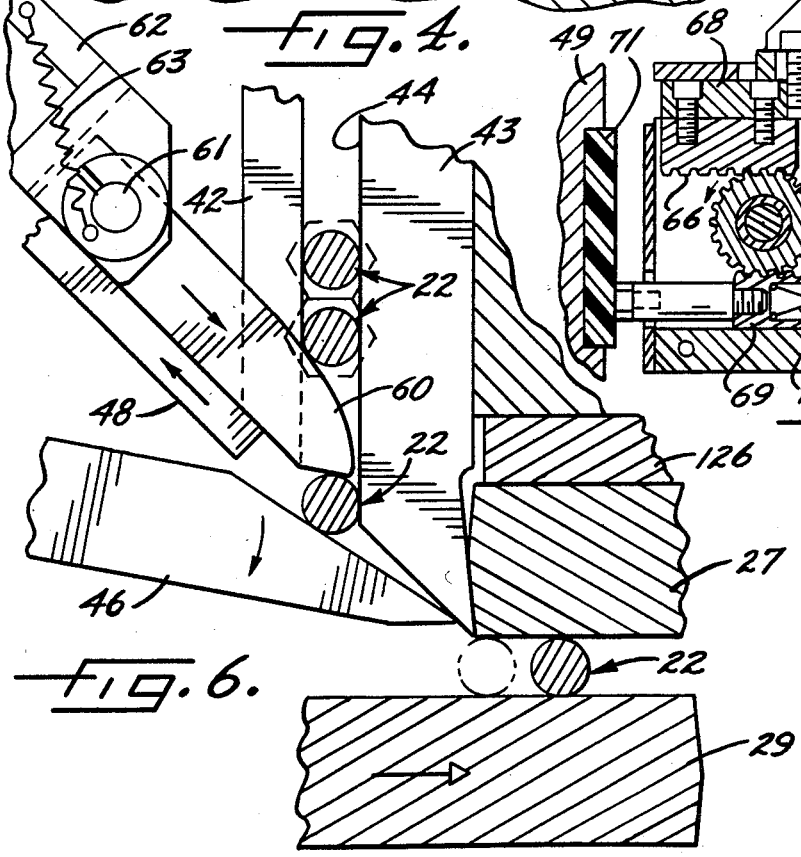
FIG. 6 is a view similar to FIG. 4 but shows certain parts in moved positions.
Figure 7:
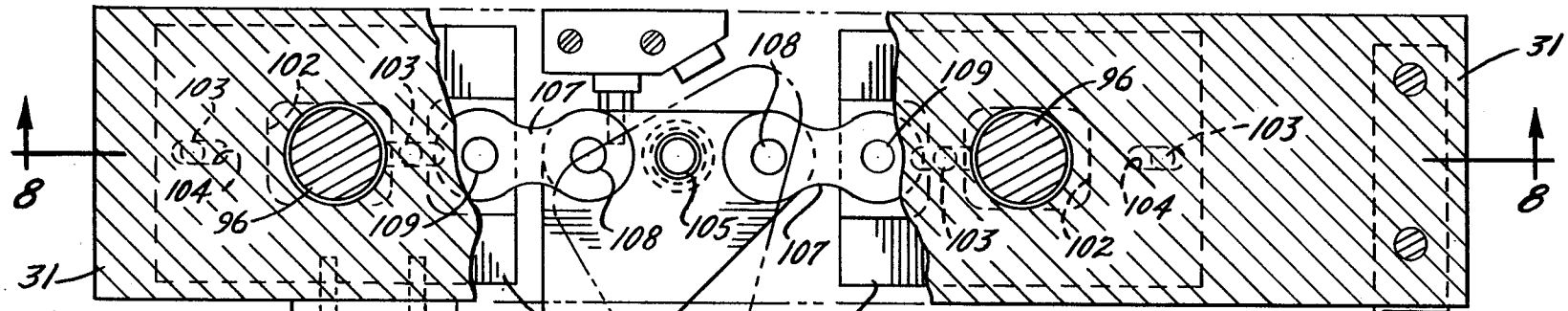
FIG. 7 is an enlarged fragmentary cross-section taken substantially along the line 7—7 of FIG. 1.

When the bellcrank 54 is pivoted clockwise, the link 51 acts through the slide 49 to retract the feed finger 48 and allow the next blank 22 to move out of the track 44 and into the injection position (see FIG. 6). When the bellcrank is rocked in a counterclockwise direction, the slide 49 and the feed finger 48 are advanced through a forward feeding stroke by a coil spring 58 (FIG. 3) telescoped over the link 51 and compressed between the ear 53 and a nut 59 on the link.

Figure 4:
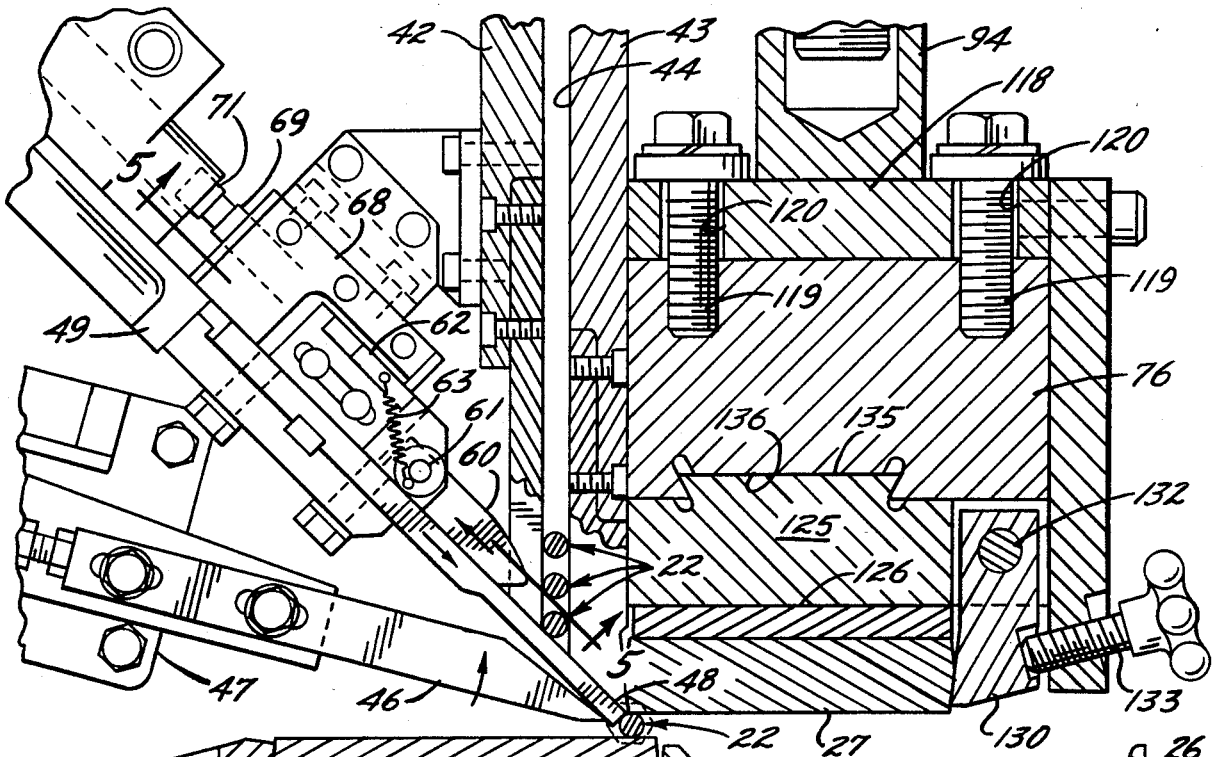
FIG. 4 is a still further enlarged view of certain parts shown in FIG. 3.
Figure 4:
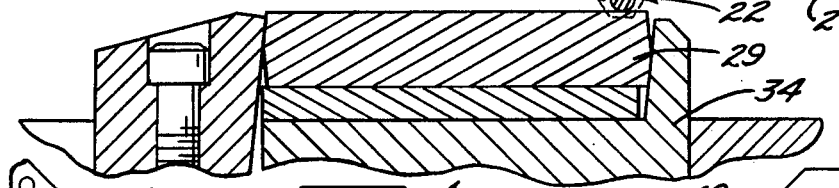

As shown in FIG. 4 the feed finger 48 is disposed at an angle of about 45 degrees with respect to the dies 27, 28 and 29, 30 and extends across the similarly angled ends of the rails 42 and 43. The particular angular disposition of the feed finger facilitates movement of the blank 22 out of the track 44 and around the forward leading corners of the fixed dies 27 and 28. As a result, each blank 22 stripped from the track 44 is positively forced through the springloaded gate 46 and against the movable dies 29 and 30 by the pressure applied by the feed finger 48 and such pressure also assists in initiating rotation of the blank between the fixed and movable dies.

In accordance with one aspect of the present invention, a catcher 60 (FIGS. 4 and 6) is automatically inserted between each blank 22 in the injection position and the following blank in the track 44. The catcher separates the two blanks from one another and prevents the following blank from interfering with the blank in the injection position as that blank is pushed from the injection position and between the dies 27, 28 and 29, 30 by the feed finger 48.

Figure 5:
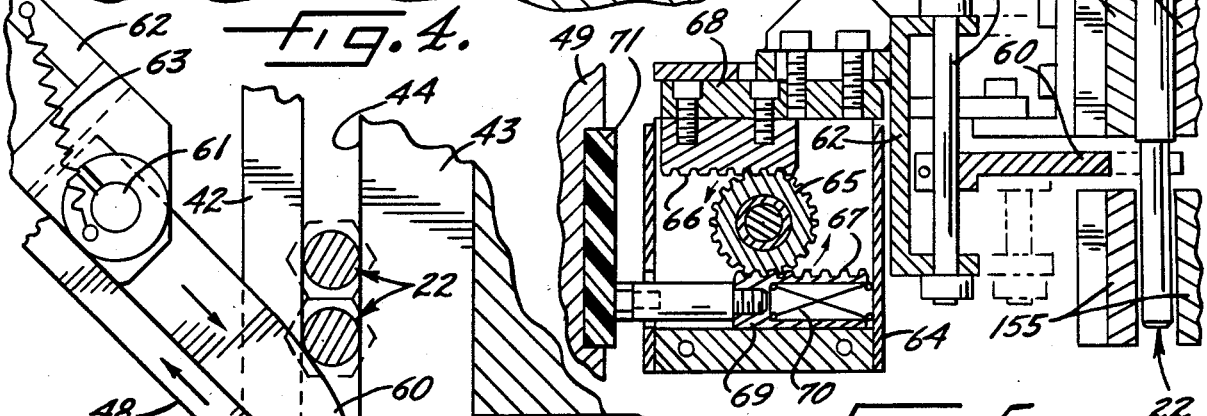
FIG. 5 is a fragmentary cross-section taken substantially along the line 5—5 of FIG. 4.

As shown in FIG. 4, the catcher 60 is in the form of an elongated finger which lies along the rear side of the feed finger 48. The catcher 60 is secured to an upright spindle 61 and may be adjusted along the spindle to enable the elevation of the catcher to be changed when the machine 21 is changed over to run different types or sizes of blanks. The spindle is rotatably supported by a mounting bracket 62 (FIG. 5) and is biased in a clockwise direction by a contractile spring 62 which is stretched between the spindle and the mounting bracket. Thus, the catcher 60 is urged against the feed finger 48 but is allowed to float about the axis of the spindle so that the catcher may find its way between adjacent blanks 22.

The mounting bracket 62 is slidably supported by a boxlike housing 64 (FIG. 5) connected rigidly to the rail 42 and is adapted to be slid back and forth on the housing so that the catcher 60 may first be inserted between and then withdrawn from adjacent blanks 22. In carrying out the invention, the catcher 60 is adapted to be shifted between active and return stroke in timed relation with movement of the feed finger 48 through return and injection strokes, respectively. For this purpose, a pinion 65 is rotatably supported within the housing 64 and meshes with a pair of racks 66 and 67 located on opposite sides of the pinion. The rack 66 is secured to a plate 68 extending from the mounting bracket 62 while the rack 67 is secured to the upper side of a plunger 69 guided slidably within the housing 64 and urged toward the slide 49 of the feed finger 48 by a coil spring 70.

When the feed finger 48 is retracted to allow a blank 22 to move from the track 44 into the injection position (see FIG. 6), the plunger 69 is shifted to the left (FIG. 5) by the spring 70, the rack 67 rotates the pinion 65 clockwise, and the pinion acts through the rack 66 to advance the catcher 60 through its active stroke. The catcher thus is thrust between the blank in the injection position and the following blank in the track 44 so as to prevent the latter blank from rubbing against and interfering with injection of the leading blank. When the feed finger is advanced, a pad 71 on the slide 49 pushes the plunger 69 to the right (FIG. 5) to cause the rack 67, the pinion 65 and the rack 66 to retract the catcher from between the two blanks (see FIG. 4). Thus, the blank 22 previously held by the catcher 60 is permitted to slide downwardly against the side of the feed finger 48 preparatory to advancing to the injection position and being stopped by the gate 46 upon retraction of the feed finger. It has been found that the catcher coacts advantageously with the gate and the feed finger to facilitate smooth and trouble-free insertion of the blanks between the dies 27, 28 and 29, 30.

Figure 11:
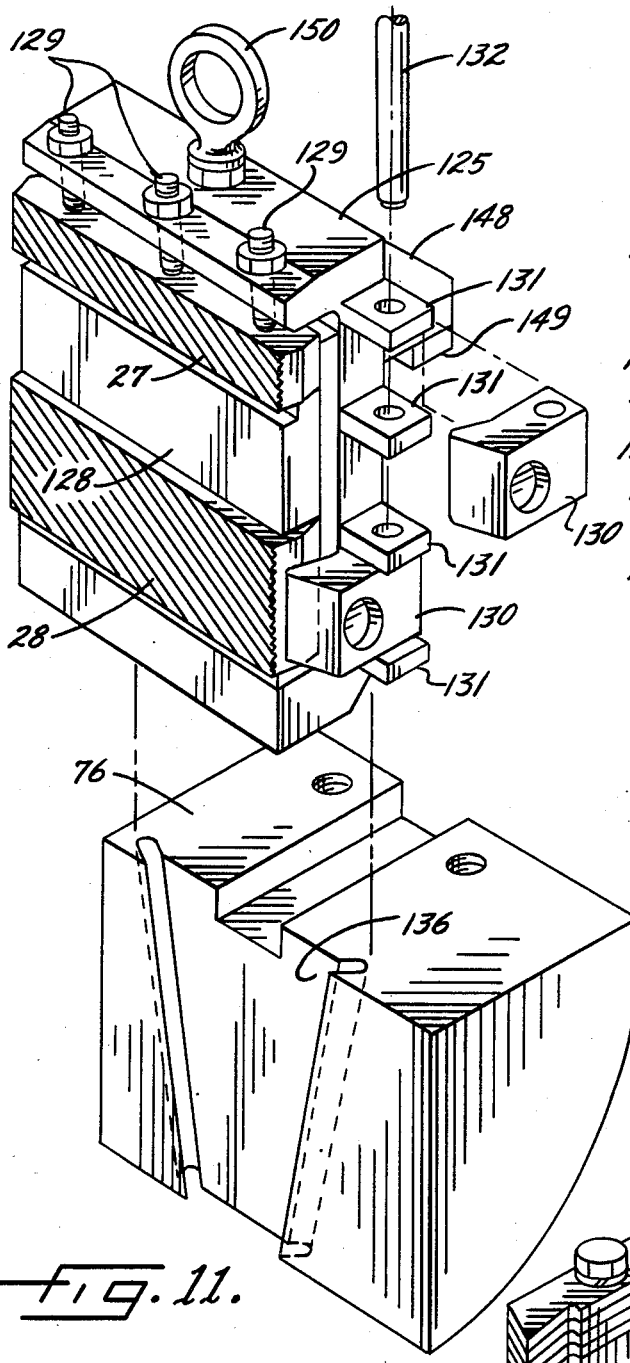
FIG. 11 is an exploded perspective view primarily showing the front side of the stationary die holder and showing the die holder removed from the machine.

The dies 27, 28 and 29, 30 are generally block-shaped and their opposing faces are formed with generally longitudinally extending thread forming elements 72 (FIG. 11) in the form of alternating flutes and valleys which extend along the faces in accordance with the helix angle of the thread to be formed. In order to properly form the thread, it is necessary that the fixed and movable dies be positioned longitudinally (i.e., in the direction of reciprocation) with respect to one another such that the thread forming elements of each die aline correctly with those of the mating die in such a manner that the impressions made by each die will form a continuous thread on the blank 22 rather than two interrupted threads. Also, the proper squeeze angle must be established between the dies in accordance with the diameter of the particular blank and the depth of the particular thread. That is to say, the face of each stationary die 27, 28 must coverage toward the face of the respective movable die 29, 30 at a precise squeeze angle as the screw proceeds along the dies so that the dies may make the thread progressively deeper. The fixed and movable dies must be transversely spaced from one another in accordance with the diameter of the blank and, in addition, the lower end portion of the lower stationary die 28 must be tilted forwardly at a proper tilt angle with respect to the lower moveable die 30 if the lower shank portion 23 of the blank is formed with a downward taper.

Accordingly, it is necessary that the dies 27, 28 and 29, 30 be properly set up relative to one another in accordance with the thread to be formed. By employing different dies, the machine 21 may be used to form different types of threads on different types and sizes of blanks. When the machine is changed over from one run to another, the relative position of the dies must be adjusted to establish the proper longitudinal alinement and transverse spacing of the thread forming elements 72 and to place the die faces at the proper squeeze and tilt angles.

In the present instance, set up and adjustment of the machine 21 are significantly simplified by making all of the adjustments to the fixed dies 27 and 28 and by mounting the fixed dies on a stack of members 73, 74, 75 and 76 (FIGS. 3, 9 and 17) which are movable relative to one another and which may be easily adjusted to establish the proper positioning of the fixed dies. More particularly, the bottom member 73 (FIG. 17) of the stack comprises a flat mounting plate adapted to be adjusted back and forth along a linear path which parallels the path of reciprocation of the movable dies 29 and 30, such adjustment effecting a change in the longitudinal alinement of the dies 27, 28 and 29, 30. The mounting plate 73 is supported directly on top of the base plate 32 and is guided to slide along its linear path by a key and keyway (not shown) between the mounting plate and the base plate.

To adjust the mounting plate 73, a reversible rotary servo motor 80 (FIG. 3) acts through a speed reducer 81 on the base plate 32 to rotate a lead screw 82. The screw is threaded into a nonrotatable nut 83 on the mounting plate 73 and, upon being rotated, the screw acts to adjust the mounting plate along a path paralleling the path of reciprocation of the movable dies 29 and 30. Such adjustment changes the longitudinal position of the stationary dies 27 and 28 relative to the movable dies and thereby brings the thread forming elements 72 of the dies into proper alinement.

The second member 74 in the stack comprises a swing plate (see FIG. 17) which may be adjusted to change the squeeze angle of the dies 27, 28 relative to the dies 29 and 30. The swing plate is mounted to pivot about an axis extending perpendicular to the path of reciprocation of the movable dies 29 and 30 and may be adjusted about such pivot to change the squeeze angle. For these purposes, an upright pivot element or pin 84 (FIG. 1) extends through a hole in the swing plate 74 and is press-fitted into a hole in the mounting plate 73, the upper end of the pin being just below the upper surface of the swing plate. The axis of the pivot pin 84 coincides quite closely with the effective leading edges of the thread forming elements 72 of the stationary dies 27 and 28, such edges being defined in this instance by the forward leading corner of each die. As a result, adjustment of the swing plate 74 about the pivot pin 84 is effective to change the squeeze angle but does not substantially change the transverse spacing between the forward leading corner of each stationary die 27, 28 and the opposing face of the opposing movable die 29, 30. Whenever the mounting plate 73 is adjusted linearly, the swing plate 74 also is adjusted in the same direction and thus the squeeze angle is not affected by adjustment of the mounting plate. The mounting block 47 for the gate 46 and the guideway 50 for the feed finger 48 are carried by and are adjustable with the swing plate 74.

Pivotal adjustment of the swing plate 74 is effected by a reversible rotary servo motor 85 (FIG. 3) which acts through a speed reducer 86 on the mounting plate 73 to rotate a lead screw 87. The latter is threaded into a non-rotatable nut 88 carried by a clevis 89 which is pivotally attached to a pin 90 rigid with and projecting upwardly from the swing plate. When the motor 85 is energized, the screw 87 acts through the nut 88 and the clevis 89 to pivot the swing plate 73 about the pivot pin 84 and thereby change the squeeze angle.

To enable adjustment of the transverse spacing between the dies 27, 28 and 29, 30, the third member 75 (FIG. 17) in the stack comprises a slide plate which is mounted on top of the swing plate 74 and which is supported for back and forth linear adjustment along a path extending substantially perpendicular to the path of reciprocation of the movable dies 29 and 30. A reversible rotary servo motor 91 (FIG. 3) acts through a right angle speed reducer 92 on the swing plate 74 and is operable to rotate a lead screw 93 which is threaded into a non-rotatable nut 94 carried by the slide plate 75. By energizing the motor, the slide plate 75 may be shifted back and forth to adjust the transverse spacing between the dies 27, 28 and the dies 29, 30. Such adjustment does not affect the longitudinal alinement or the squeeze angle of the dies.

The adjusting motors 80, 85 and 91 may be controlled from a manual control panel (not shown) or preferably by an automatic control such as a microprocessor (not shown). Position encoders 95 (FIGS. 2 and 3) are associated with the three lead screws 82, 87 and 93 to signal the actual position of each screw to the microprocessor. Motorized adjustment of the three plates 73, 74 and 75 reduces the time and effort required to set up the machine 21.

In accordance with another aspect of the present invention, the plates 73, 74 and 75 are adapted to be automatically unclamped for adjustment purposes and then automatically re-clamped once the adjustments have been effected by the motors 80, 85 and 91. By virtue of the automatic unclamping and re-clamping, setting up of the overall machine 21 is more completely automated so as to enable the set up to be effected quickly and easily.

Figure 3:
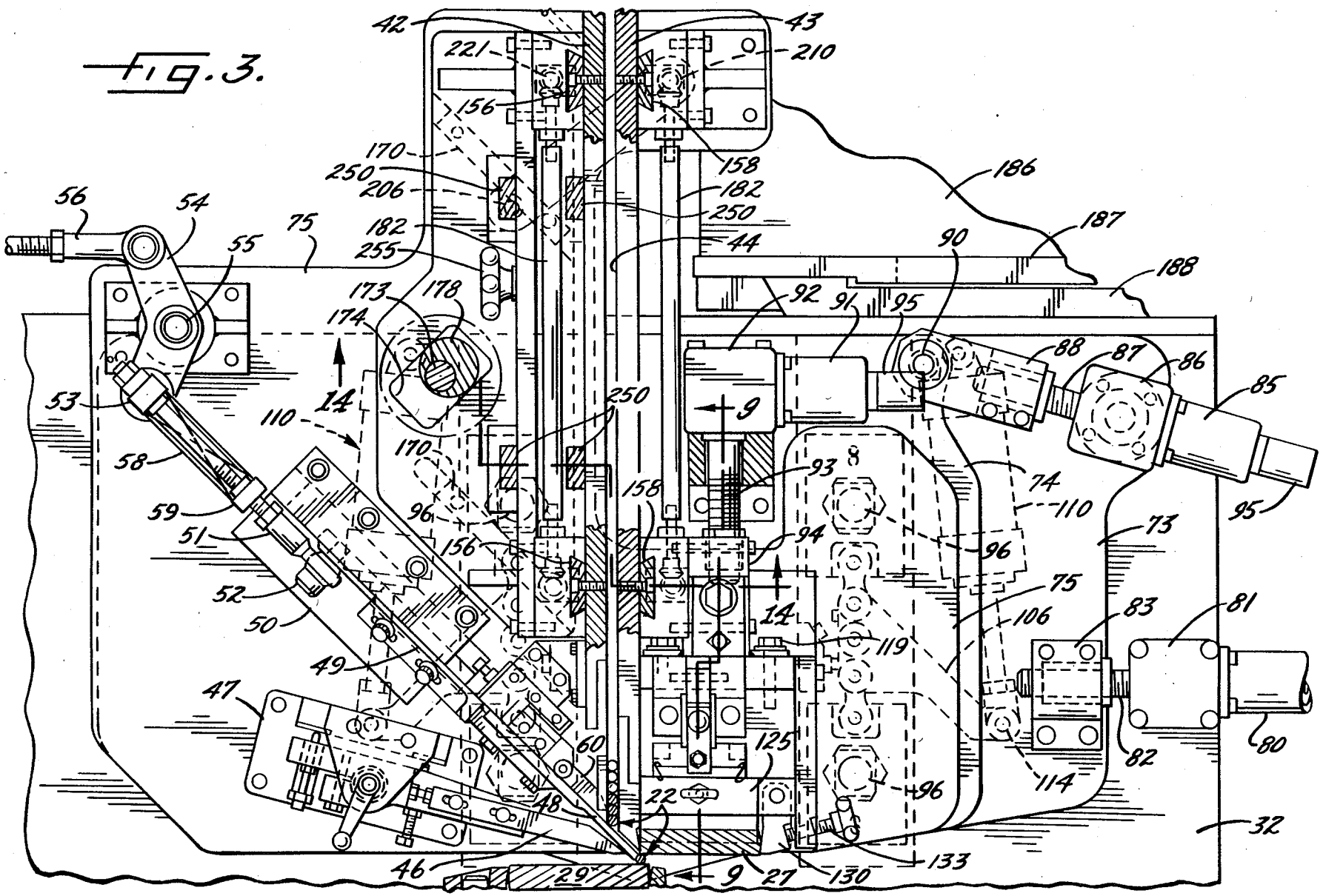
FIG. 3 is an enlarged view of certain parts shown in FIG. 2.
Figures 17, 18:
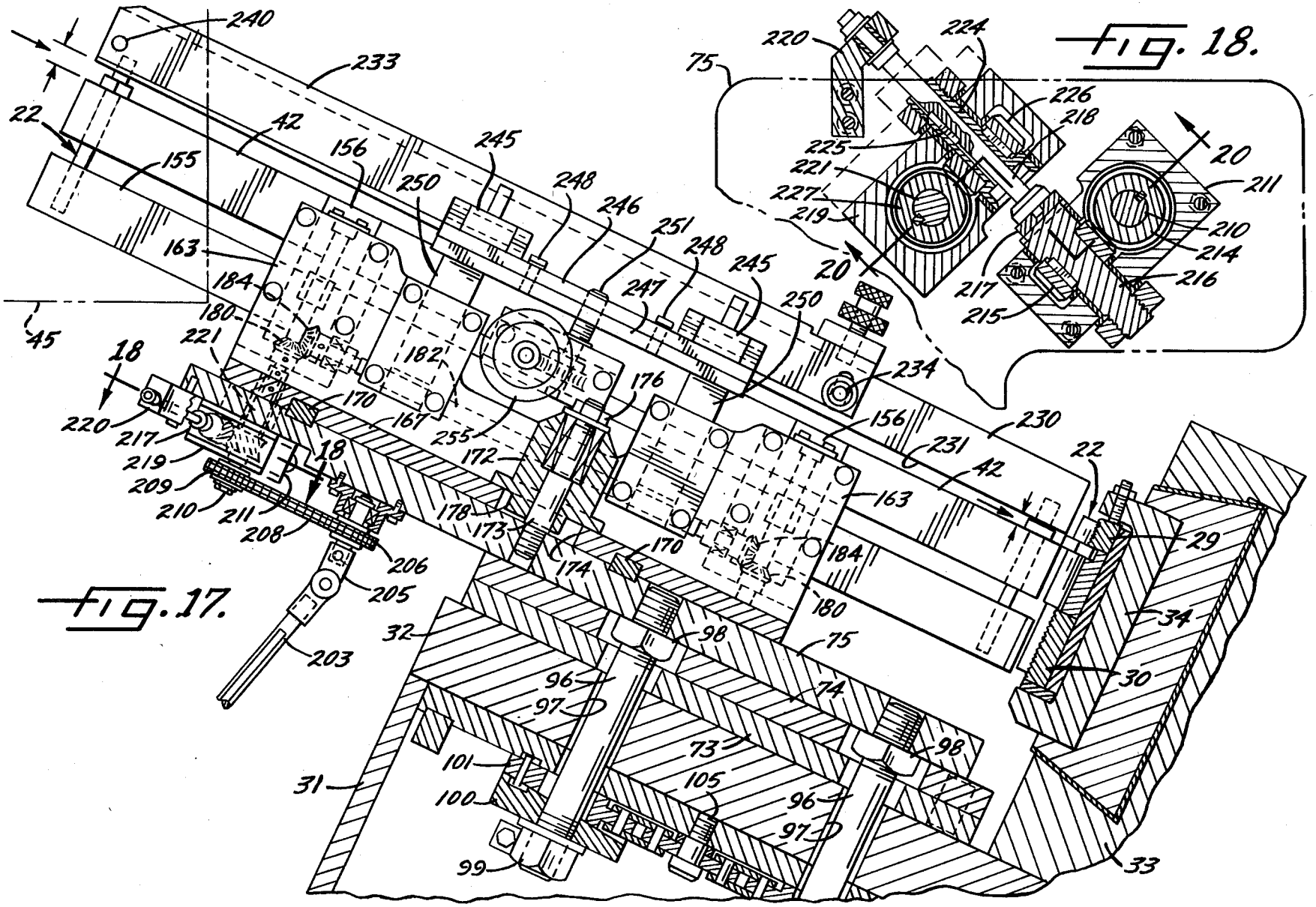
FIG. 17 is an enlarged fragmentary cross-section taken substantially along the line 17—17 of FIG. 2.
FIG. 18 is an enlarged fragmentary cross-section taken substantially along the line 18—18 of FIG. 17.

More particularly, the plates 73, 74 and 75 are adapted to be unclamped when four rods 96 (FIGS. 3, 7, 8 and 17) are released and are adapted to be re-clamped when downward force is applied to the rods. As shown in FIG. 3, two rods are disposed on each side of the track 44. Each rod is threaded on each end (see FIGS. 8 and 17) and extends slidably through alined openings 97 in the base 31, the base plate 32, the slide plate 73 and the swing plate 74. The upper end of each rod is threaded into the slide plate 75 and is held tightly by a lock nut 98 (FIG. 17). The openings 97 in the slide plate 73 and the swing plate 74 are sufficiently large to permit adjustment of those plates in the desired direction and through the desired range.

Figure 8:
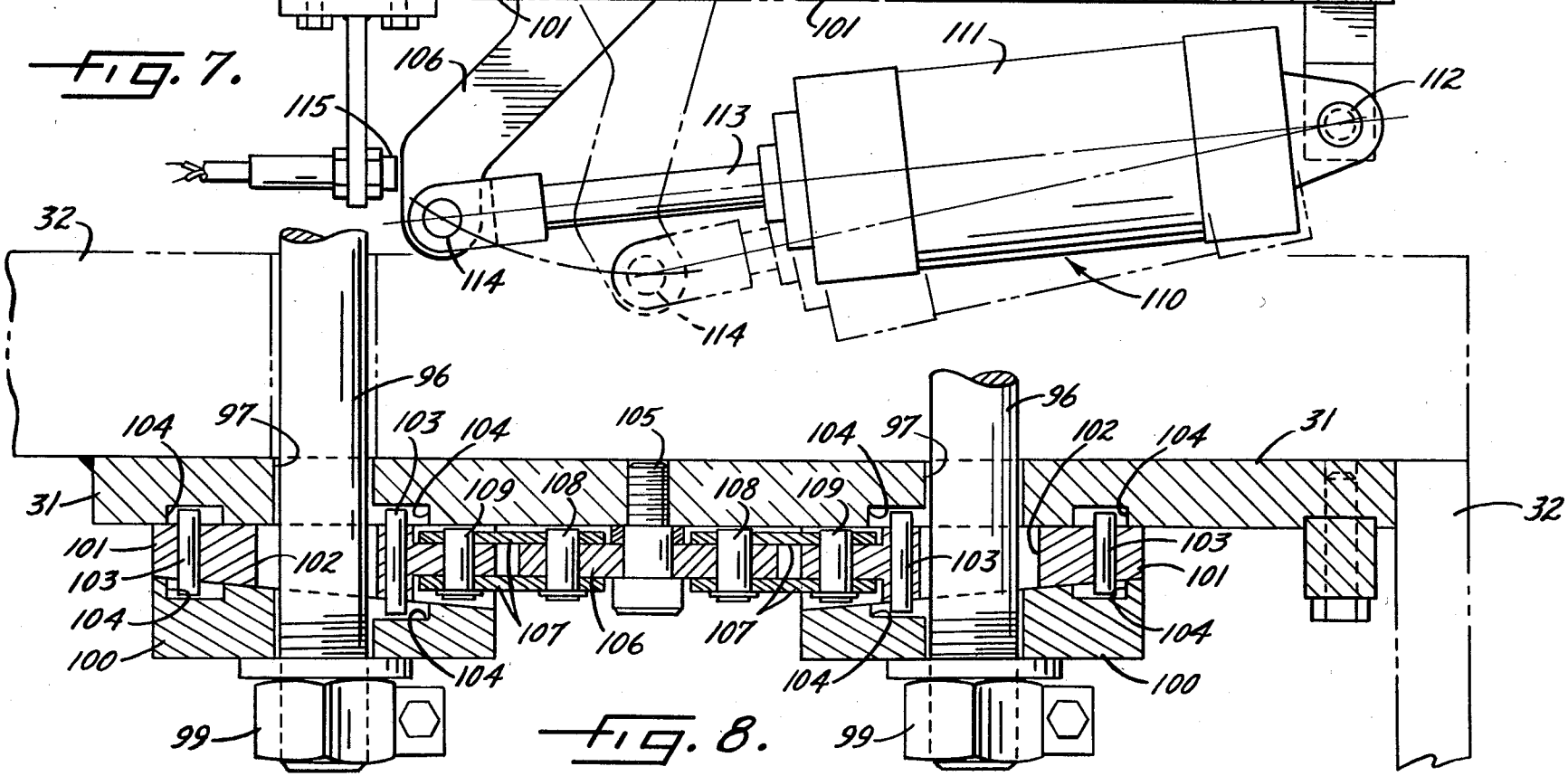
FIG. 8 is a fragmentary cross-section taken substantially along the line 8—8 of FIG. 7.

As shown in FIG. 8, a nut 99 is threaded onto the lower end portion of each rod 96 and captivates a wedge-shaped abutment or block 100 thereon. In carrying out the invention, a power-actuated wedge 101 is adapted to be forced against each block to exert downward force on the slidable rod 96 and thereby tightly clamp the plates 73, 74 and 75 to one another and to the base plate 32. Each wedge 101 is located between the block 100 and the underside of the base 31 and is formed with a large clearance opening 102 (FIG. 8) for receiving the rod 96. Pins 103 projecting in opposite directions from the wedge 101 extend into slots 104 in the base 31 and the block 100 to permit back and forth sliding of the wedge while captivating the wedge against turning.

Located between the wedges 101 on each side of the track 44 and pivotally mounted at 105 (FIG. 7) on the base 31 is a bellcrank 106. Oppositely extending links 107 are pivotally connected to the bellcrank at 108 and pivotally connected to the wedges at 109. When the bellcrank is located to position the wedges in their active or clamping positions shown in FIG. 8 and in full lines in FIG. 7, the pivot points 105, 108 and 109 lie along a straight line.

Shifting of each pair of wedges 101 between their clamping and unclamping positions is effected by a reciprocating pneumatic actuator 110 (FIG. 7) having a cylinder 111 pivotally connected to the base 31 at 112 and having a rod or ram 113 pivotally connected to the bellcrank 106 at 114. When the ram is retracted, the bellcrank is pivoted counterclockwise from the position shown in full lines in FIG. 7 to the position shown in broken lines and, as an incident thereto, acts through the links 107 to withdraw the wedges 101 out of wedging engagement with the blocks 100. As a result, the downward pressure on the rods 96 is released to unclamp the plates 73, 74 and 75 and enable adjustment of the plates.

When the ram 113 of each actuator 110 is extended, the associated bellcrank 106 is pivoted in a clockwise direction to force the wedges 101 tightly between the base 31 and the blocks 100. The downward pressure applied by the wedges to the blocks forces the rods 96 downwardly to clamp the plates 73, 74 and 75 to one another and to the base plate 32. As each wedge moves into its fully clamped position, the pivot 108 moves to a position lying on the line extending between the pivots 105 and 109 and thus the wedge is tightly held in its clamped position with a toggle action. A proximity switch 115 (FIG. 7) on the base 31 senses the position of the bellcrank 106 and produces a signal for stopping advancement of the ram 113 when the wedges 101 are fully clamped.

It will be appreciated that the provision of the rods 96, the wedges 101 and the actuators 110 avoids the need of manually releasing the plates 73, 74 and 75 for adjustment and then re-clamping the plates after the adjustment has been effected. Thus, the time required to set up the machine 21 is significantly reduced.

The fourth member 76 in the stack holds the stationary dies 27 and 28 and is essentially the same as the construction disclosed in Jackson U.S. Pat. No. 4,229,966. Briefly, the member 76 comprises a block (see FIG. 9) having a convexly arcuate rear face 117 which seats against a concave cradle 118 welded to and upstanding from the slide plate 75. Screws 119 extend through enlarged openings 120 in the cradle and are threaded into the block 76. When the screws are loosened, the block may be adjusted along the cradle to change the taper angle of the dies 27 and 28. To effect the adjustment, two screws 121 and 122 extend through a rearwardly projecting tongue 123 attached rigidly to the block 76. The screw 121 is threaded in the tongue and engages the upper side of the nut 94 while the screw 122 extends loosely through the tongue and is threaded into the nut. When the screw 122 is loosened, the screw 121 may be tightened or loosened to adjust the block 76 upwardly and downwardly along the cradle 118.

Figures 9, 10:
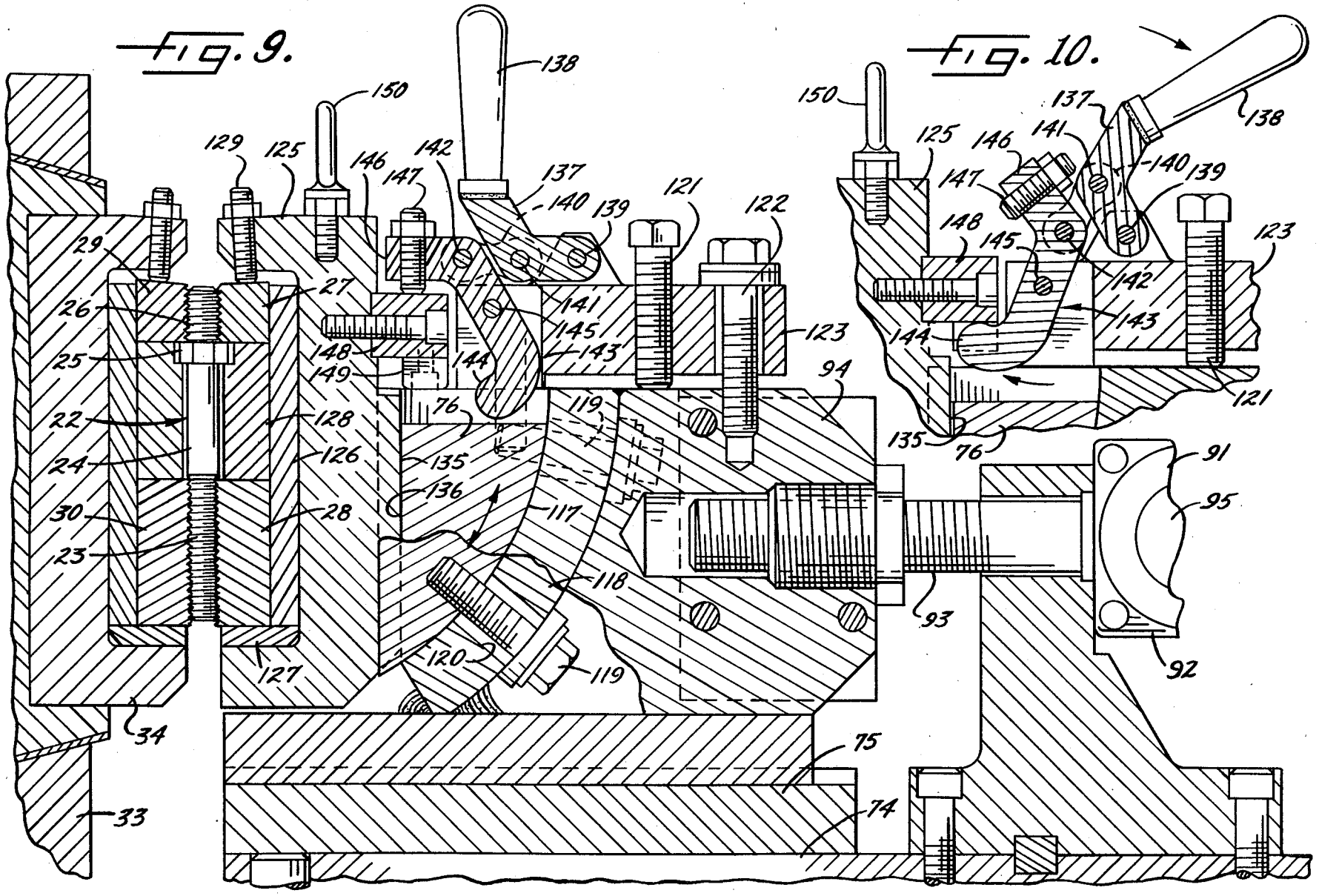
FIG. 9 is an enlarged fragmentary cross-section taken substantially along the line 9—9 of FIG. 3.
FIG. 10 is a fragmentary view similar to FIG. 9 but shows certain parts in moved positions.

As shown in FIG. 9, a generally U-shaped die holding member 125 is attached to the block 76. The dies 27 and 28 are backed by a shim 126 in the die holder 125 while a second shim 127 underlies the lower die 28, thereby being a filler block 128 between the dies. The entire package is clamped in the die holder 125 by screws 129 which engage the upper die 27. In addition, clamps 130 (FIGS. 11 and 12) engage the ends of the dies 27 and 28, the clamps being supported between ears 131 on the die holder, being fastened to the ears by a pin 132, and being held by screws 133 (FIG. 4).

With prior thread rolling machines, difficulty is encountered in changing the stationary dies 27 and 28 because the stationary die holder is in a vertically inclined position and gravity makes it difficult to locate the dies precisely in the holder before the dies are clamped. Also, the movable dies 29 and 30 and the movable die holder 34 obstruct free access to the stationary dies. It thus is difficult to install the stationary dies in accurately located positions in the holder.

To simplify changing of the stationary dies 27 and 28, the present invention contemplates the provision of a new and improved die holder 125 (FIGS. 11 and 12) which may be easily removed from the machine 21, precisely fitted with new dies, and then locked securely and accurately in the machine. Because the fixed dies may be changed with the holder 125 out of the machine, the time and effort required to effect the changeover is significantly reduced.

Figure 12:
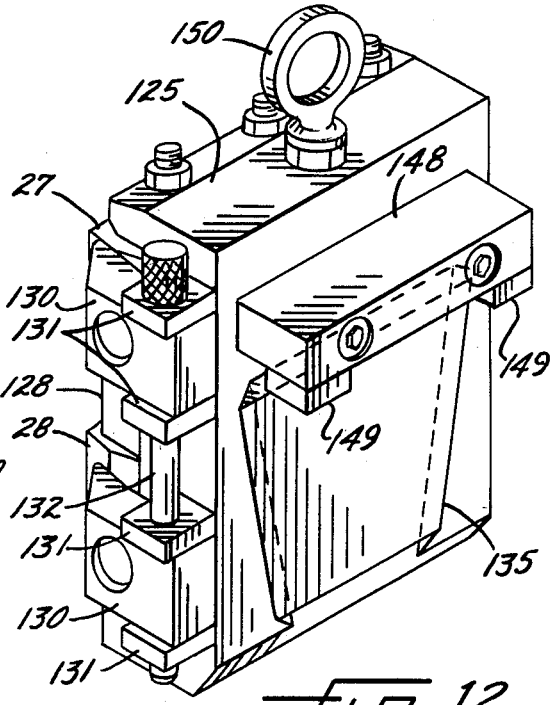
FIG. 12 is a perspective view primarily showing the rear side of the stationary die holder.

In carrying out this aspect of the invention, the rear face of the die holder 125 is formed with a downwardly tapered dovetail gib 135 (see FIGS. 4 and 12). The gib is adapted to wedgingly engage a downwardly tapered dovetail guideway 136 (FIGS. 4 and 11) formed in the forward face of the block 76. When the gib is fully seated in and wedged against the guideway, the die holder 125 is securely held and is precisely located against both fore-and-aft and lateral movement.

To clamp the die holder 125 vertically, a lever 137 (FIGS. 9 and 10) with an upstanding handle 138 is pivotally connected to the tongue 123 at 139. One end of a link 140 is pivotally connected to the lever at 141 while the other end of the link is pivotally connected at 142 to a clamping lever 143. The latter includes an arm 144 extending into slots in the tongue 123 and the block 76 and pivotally connected to the tongue at 145. A second arm 146 of the lever 143 carries an adjustable screw 147 adapted to overlie a bar 148 attached to the rear side of the die holder 125 and having a pair of accurately machined locating pads 149 adapted to rest on the upper side of the block 76 to locate the die holder in a precisely established vertical position.

When the lever 137 is swung counterclockwise from the position shown in FIG. 10 to the position shown in FIG. 9, the link 140 acts through the lever 143 to cause the screw 147 to engage the bar 148 and thereby apply a downward clamping force to the die holder 125 to hold the gib 135 in tight engagement with the guideway 136. As the lever 143 reaches its clamped position, the link 140 toggles to a position in which the pivots 139, 141 and 142 lie along a straight line and thus the die holder 125 is clamped with a toggle action.

Figure 13:
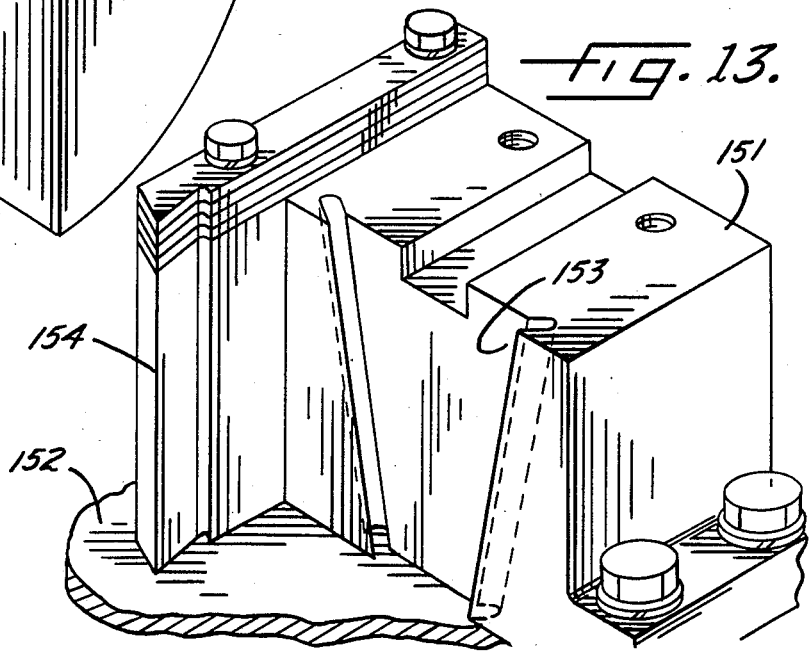
FIG. 13 is a perspective view of a work bench fixture for locating the stationary die holder when dies are installed in the holder.

When the lever 137 is swung clockwise, the arm 144 of the lever 143 engages the underside of the bar 148 and lifts the die holder 125 so as to unseat the gib 135 from the guideway 136 (see FIG. 10). The die holder 125 then may be lifted out of the machine 21 by means of a ring 150 attached to the top of the die holder. Advantageously, a fixture 151 (FIG. 13) is provided for locating the die holder in a precise position on a work bench 152 while the dies 27 and 28 are being changed. The fixture includes a guideway 153 identical to the guideway 136 and adapted to receive the gib 135. The various locating surfaces of the fixture are the same as the locating surfaces of the block 76, the fixture also including an inclined surface 154 simulating the tip of the rail 43. Thus, dies installed in accurately gaged positions in the die holder while the latter is held in a convenient position by the fixture will be located in the same accurate positions when the die holder is remounted in the block.

Figure 14:
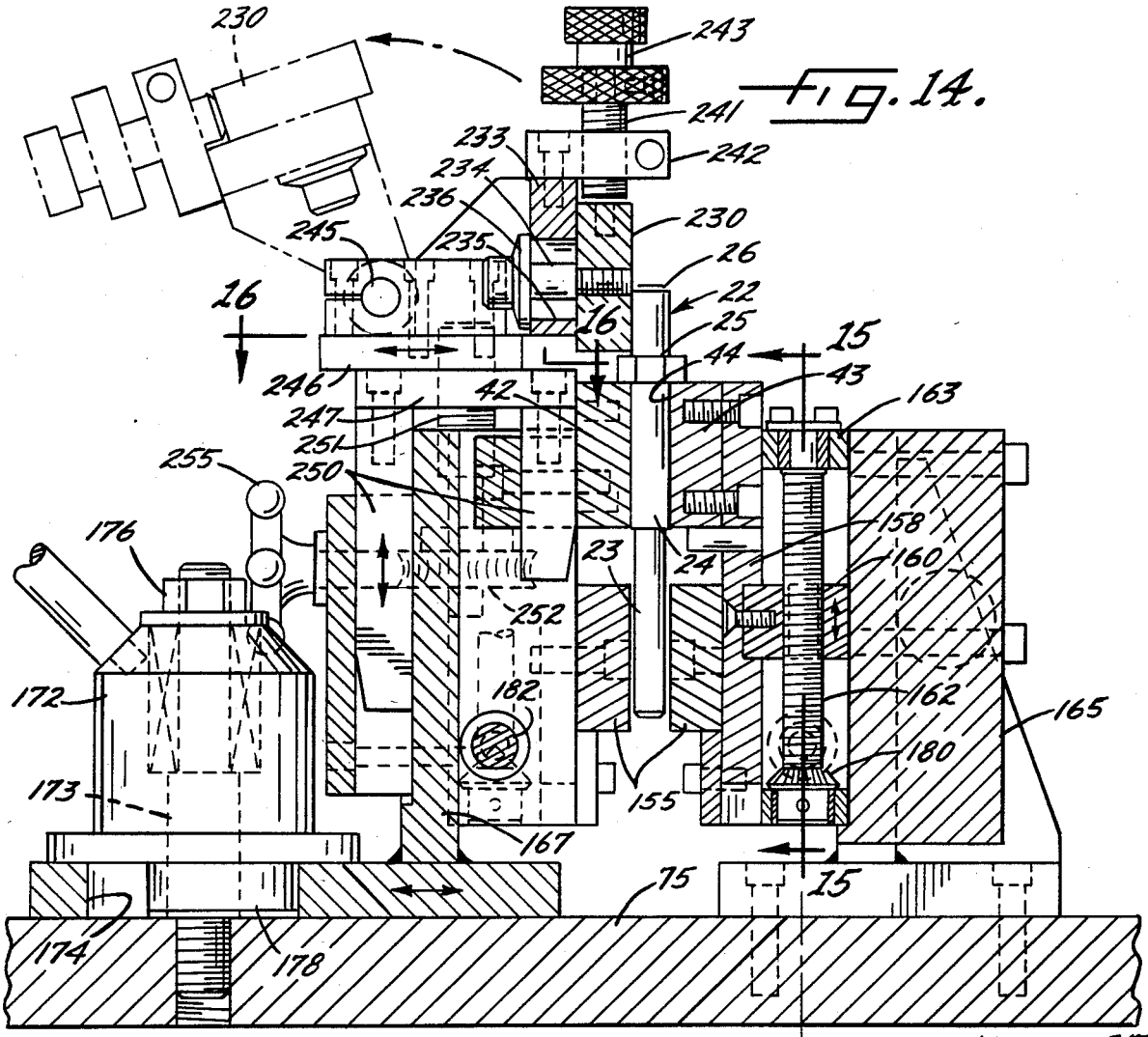
FIG. 14 is an enlarged fragmentary cross-section taken substantially along the line 14—14 of FIG. 3.

In the present instance, the fastener blanks 22 are supported on the rails 42 and 43 by virtue of the collars 25 of the blanks resting on the upper sides of the rails so that the intermediate portion 24 of each fastener hangs between the rails (see FIG. 14). Preferably, a second pair of rails 155 is spaced below the rails 42 and 43 to confine the lower shank portion 23 of each fastener.

When the machine 21 is changed over to run fastener blanks 22 of different lengths, the elevation of the rails 42 and 43 must be changed to accommodate the new length and to cause the blanks to be located at the proper elevation when the blanks are fed between the dies 27, 28 and 29, 30. According to another aspect of the invention, provision is made to automatically adjust the elevation of the rails 42 and 43. Moreover, the vibratory bowl 45 is automatically adjusted in unison with the rails so that a fixed relationship is always maintained between the bowl and the entrance ends of the rails regardless of the elevation of the rails.

Figure 15:
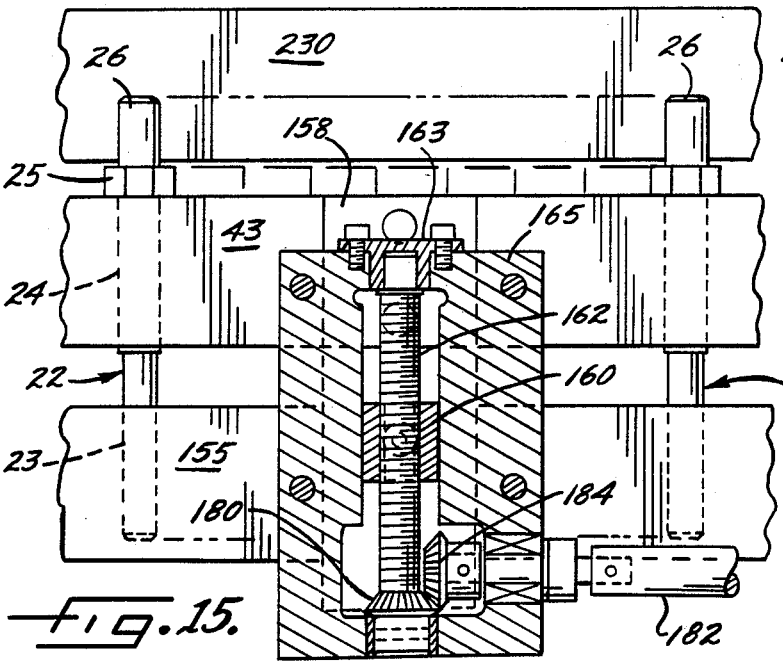
FIGS. 15 and 16 are fragmentary cross-sections taken substantially along the lines 15—15 and 16—16, respectively, of FIG. 14.
Figure 19:
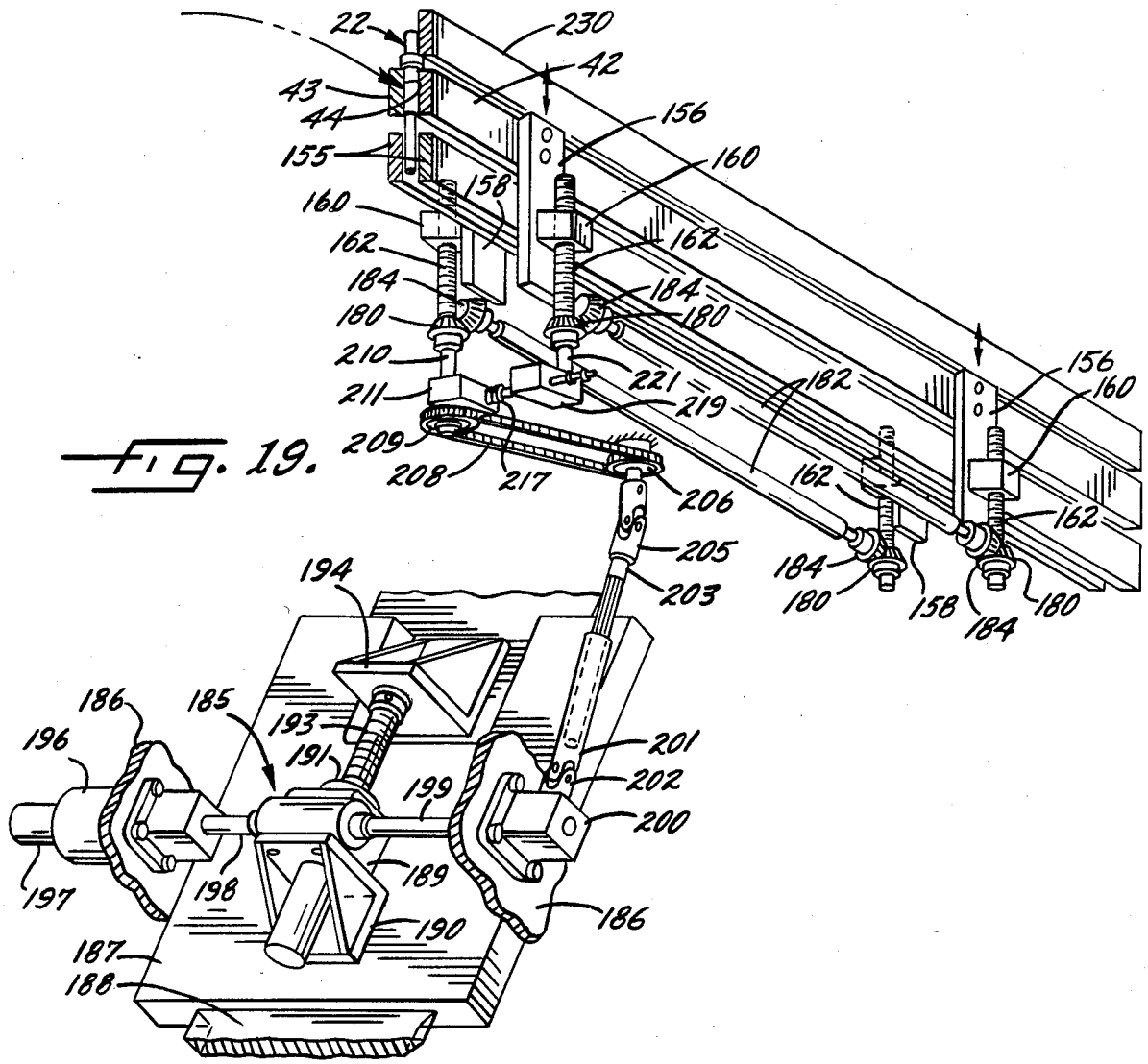
FIG. 19 is a perspective view in somewhat schematic form of the drive mechanism for adjusting the hopper and the tracks.

Herein, the rail 42 is secured to a pair of front and rear standards 156 while the rail 43 is secured to a similar pair of front and rear standards 158 (see FIG. 19). Each standard carries aa non-rotatable nut 160 which receives a vertically extending lead screw 162. The ends of the screws are journaled in cages 163 (FIGS. 14 and 15) connected to support members 165 and 167 which, in turn, are secured to the slide plate 75 so that both rails 42 and 43 undergo whatever adjustment is imparted to the slide plate 75. The support member 165 is associated with the rail 43 and is fixed rigidly to the slide plate 75. The support member 167 for the rail 42, however, is adjustable laterally on the slide plate 76 so that the rail 42 may be moved toward and away from the rail 43 to adjust the lateral width of the track 44 when the machine 21 is changed over to turn blanks of a different diameter. For this purpose, guide keys 170 (FIGS. 3 and 17) are located between the support member 167 and the slide plate 75 and extend at a 45 degree angle to the rails 42 and 43. The support member 167 normally is clamped tightly to the slide plate 75 by a locking device 172 (FIGS. 3, 14 and 17) supported on a stud 173 which extends through an opening 174 in the support member and which is threaded into the slide plate. When a nut 176 on the upper end of the stud 173 is loosened, the locking device 172 unclamps the support member 167 and is capable of being turned on the stud. An eccentric cam 178 is formed on the lower end of the locking device and, when the latter is turned, the cam bears against either the forward or rear wall of the opening 174 so as to either push the support member 167 and the rail 42 laterally at a 45 degree angle toward the rail 43 or to pull the rail 42 away from the rail 43. This adjusts the lateral spacing between the rails and, at the same time, keeps the tip of the rail 42 in proper relationship to the 45 degree feed finger 48.

When the lead screws 162 are rotated, the rails 42 and 42 are adjusted upwardly and downwardly relative to the slide plate 75 to change the elevation of the rails. To effect rotation of the screws, a bevel gear 180 (FIGS. 14, 15 and 17) is secured to the lower end of each screw. A shaft 182 extends between each set of forward and rear screws and its ends carry bevel gears 184 which mesh with the gears on the screws. Thus, rotation of a rear screw is transmitted to a front screw by way of the shaft and the gears.

In keeping with the invention, a drive mechanism 185 (FIG. 19) is selectively operable to adjust the rails 42 and 43 upwardly and downwardly and, at the same time, to adjust the bowl 45 upwardly and downwardly in unison with the rails. As shown most clearly in FIG. 1, the bowl is supported on a pedestal 186 having a mounting plate 187 which is guided by means of a dovetail way construction to slide upwardly and downwardly on a plate 188 which is fixed to the rear of the base 31. The drive mechanism 185 comprises a worm gear screw jack 189 (FIG. 19) mounted on a bracket 190 on the plate 187 and having a rotatable nut 191 which receives a non-rotatable lead screw 193. The upper end of the screw 193 is connected to a bracket 194 on the plate 188 and thus the plate 187, the screw jack 189 and the bowl 45 are shifted upwardly or downwardly relative to the plate 188 when the nut 191 is rotated.

To rotate the nut 191, a reversible servo motor 196 (FIG. 19) with a feedback encoder 197 is supported by the pedestal 186 and is connected to the screw jack 189 by a shaft 198 which acts through the screw jack to rotate the nut when the motor is energized. A second shaft 199 leading from the screw jack 189 also is rotated when the motor is energized and acts to drive a right angle gear box 200 on the pedestal 186. A tubular shaft 201 is connected to the output of the gear box by a universal joint 202 and telescopically receives a splined shaft 203 which is connected to rotate the shafts 182 and the screws 162 and thereby effect up and down adjustment of the rails 42 and 43. Accordingly, energization of the motor 196 effects simultaneous adjustment of the bowl 46 and the rails 42 and 43.

Figure 20:
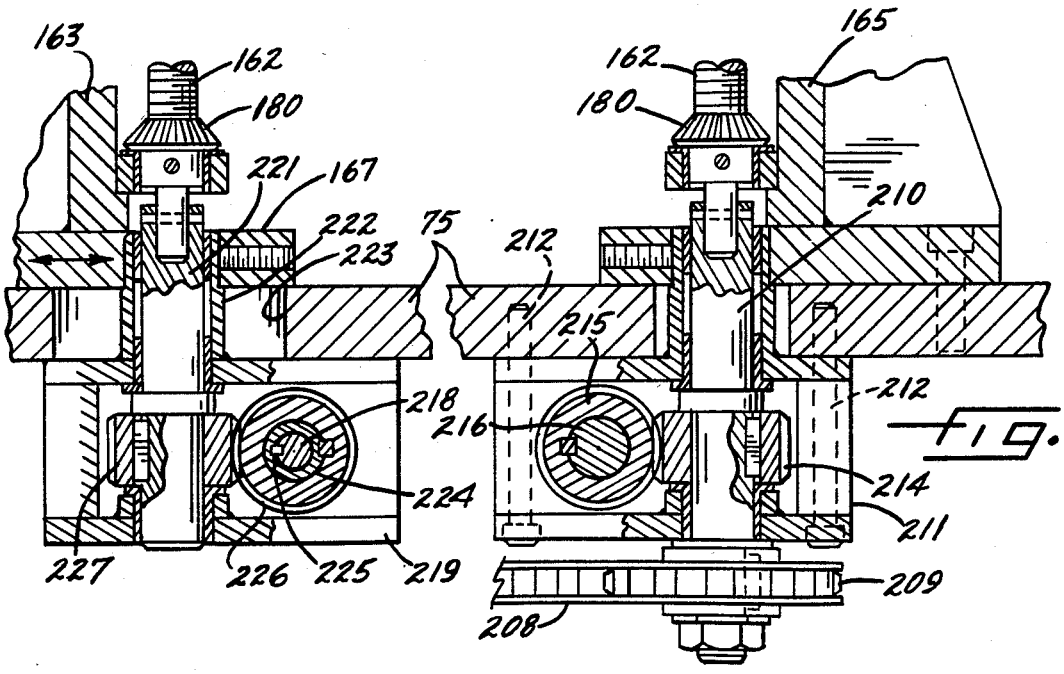
FIG. 20 is an enlarged fragmentary cross-section taken substantially along the line 20—20 of FIG. 18.

Importantly, the shaft 203 is connected to the rails 42 and 43 in such a manner as to effect up and down adjustment of the rails while permitting the rail 42 to be adjusted laterally relative to the rail 43. As shown in FIG. 19, the shaft 203 is connected by a universal joint 205 to a sprocket 206 rotatably supported on the underside of a rearward extension of the slide plate 75. A drive chain 208 connects the sprocket 206 to a second sprocket 209 which is keyed to a shaft 210 connected to and extending downwardly from the rear screw 162 for the rail 43. The shaft 210 is journaled in the slide plate 75 and also in a gear box 211 located beneath the slide plate and fastened to the latter by screws 212 (see FIG. 20).

A 45 degree helical input gear 214 (FIGS. 18 and 20) in the gear box 211 is rotatable with the shaft 210 and meshes with another 45 degree helical gear 215 which is disposed at right angles to the gear 214. The gear 215 is fixed to a shaft 216 which extends through the gear box 211. Carried on one end of the shaft 216 is a universal coupling 217 similar to an Oldham coupling and serving to connect the shaft 216 to another shaft 218 while permitting radial misalinement between the two shafts. The two shafts extend at a 45 degree angle to the rails 42 and 43 and extend parallel to the guide keys 170.

The shaft 218 extends through a gear box 219 (FIG. 18) and is journaled in a bracket 220 fixed to the underside of the slide plate 75. A vertical shaft 221 (FIG. 20) is journaled in and extends through the gear box 219 and is journaled by a bearing 222 attached to the rail support member 167 and extending through an enlarged clearance opening 223 in the slide plate 75. The upper end of the shaft 221 is connected to the lower end of the rear screw 162 for the rail 42.

Journaled in the gear box 219 and telescoped slidably over the shaft 218 is a sleeve 224. A key 225 connects the sleeve 224 to the shaft 218 to cause the shaft to rotate the sleeve while permitting the sleeve and the gear box 219 to slide along the shaft. A 45 degree helical gear 226 is keyed to the sleeve 224 and meshes with a 45 degree helical output gear 227 keyed to the shaft 221 and disposed at right angles to the gear 226.

With the foregoing arrangement, the shaft 203 acts through the chain 208 and the shaft 210 to rotate the rear lead screw 162 for the rail 43 and effect rotation of the forward lead screw for that rail by way of the shaft 182 and the bevel gears 180 and 184. The shaft 203 also acts through the chain 208 and the shaft 210 to rotate the gears 214 and 215, the shafts 216 and 218, the sleeve 224, the gears 226 and 227, the shaft 221 and the rear lead screw 162 for the rail 42. The shaft 221 also acts through the shaft 182 to rotate the forward lead screw for the rail 42. When the bowl 45 is adjusted upwardly or downwardly, the splined shaft 203 telescopes out of or into the shaft 201 to accommodate movement of the bowl relative to the sprocket 206.

When the rail 42 is adjusted toward and away from the rail 43 by the cam 178, the gear box 219 and the sleeve 224 slide along the shaft 218 to cause the shaft 221 and the rail 42 to move at a 45 degree angle toward or away from the shaft 210 and the rail 43. If, for example, the rail 42 is adjusted away from the rail 43, the gear box 219 moves away from the gear box 211 from the position shown in full lines in FIG. 18 to the position shown in broken lines. During such movement, the sleeve and the gear 226 slide along the shaft 218. In this way, a rotative drive is maintained from the shaft 210 to the shaft 221 at all times and yet the shaft 221 may be adjusted relative to the shaft 210 along a 45 degree line so as to permit lateral adjustment of the rail 42 and to permit the tip of the rail to be maintained in proper position relative to the feed finger 48. The universal coupling 217 allows the shafts 216 and 218 to accommodate tolerance accumulations as the rail 42 and the gear box 219 are adjusted along parallel 45 degree lines.

As the fastener blanks 22 travel down the rails 42 and 43, they are captivated loosely by a hold-down rail 230 (FIGS. 14 and 17) which herein engages the upper side of the wrenching collar 25 of each blank. The hold-down rail 230 extends along the full length of the rails 42 and 43 and is spaced above the latter rails by a distance approximately equal to the height of the wrenching collar 25 so that a throat 231 (FIG. 17) is defined between the rail 230 and the rails 42 and 43. As shown in FIG. 17, however, the spacing between the rails 42 and 43 and the rear end portion of the hold-down rail 230 is greater than the spacing between the rails 42 and 43 and the forward end portion of the hold-down rail 230 and thus the throat 231 tapers to a reduced height as it progresses forwardly. The tapered throat is desirable in order to provide ample clearance at the rear ends of the rails for the wrenching collars 25 to freely enter the throat as the blanks leave the bowl 45 and then to reduce the clearance and captivate the blanks with the hold-down rail 230 as the blanks proceed down the rails 42 and 43.

When the machine 21 is changed over to run different blanks, it may be necessary not only to adjust the overall spacing between the rail 230 and the rails 42 and 43 but also to adjust the degree of taper of the throat 231. Pursuant to another aspect of the present invention, these two adjustments may be effected independently of one another so as to reduce the need for and the imprecision of trial and error adjustments.

As shown most clearly in FIG. 14, the hold-down rail 230 lies alongside and is supported on an elongated mounting bar 233. A screw 234 extends through an enlarged opening 235 in the forward end portion of the mounting bar and is threaded into the forward end portion of the hold-down rail. Located between the bar and the head of the screw is a Belleville washer 236 which acts to clamp the bar to the hold-down rail.

In carrying out the invention, the rear end portion of the hold-down rail 230 is connected to the rear end portion of the mounting bar 233 by a horizontal pivot pin 240 (FIG. 17) which enables the forward end portion of the hold-down rail to be pivoted upwardly and downwardly to change the taper of the throat 231. To effect such pivoting, a tubular screw 241 (FIG. 14) is threaded into an ear 242 fastened to the forward end portion of the mounting bar 233 and overlying the forward end portion of the hold-down rail 230, the lower end of the screw bearing against the upper side of the rail. A second screw 243 is telescoped into the screw 241 and is threaded into a bore in the upper side of the rail 230. When the screws 241 and 243 are loosened, the screw 241 may be tightened or loosened to swing the forward end portion of the rail 230 downwardly or upwardly about the pivot pin 240 and thereby adjust the taper of the throat 231.

The mounting bar 233 is supported by a pair of hinges 245 and, together with the hold-down rail 230, may be swung to an out of the way position shown in broken lines in FIG. 14 so as to enable access to be gained to the rails 42 and 43 and the blanks 22 therein without interference from the hold-down rail. The hinges 245 are mounted on a supporting plate 246 (FIGS. 14 and 15) which, in turn, rests on and is adjustable laterally relative to a second plate 247 so that the lateral position of the hold-down rail may be adjusted. Screws 248 extend through laterally elongated slots 249 in the plate 246 and are threaded into the plate 247. When the screws 248 are loosened, the plate 246 and the hold-down rail 230 may be adjusted laterally in order to set the hold-down rail in the proper lateral position relative to the particular fastener blanks being run by the machine 21.

Figure 16:
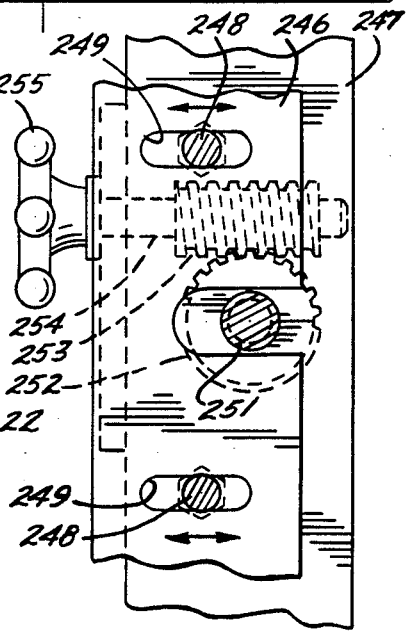

Secured to the supporting plate 247 are depending fingers 250 (FIG. 17) which are guided for up and down sliding by the support member 167. Up and down adjustment of the hold-down rail 230 is effected by raising and lowering the support plate 247 relative to the support member 167. For this purpose, the upper end portion of a lead screw 251 (FIGS. 14, 16 and 17) is threaded into the plate 247 while the lower end portion of the lead screw is journaled in the support member 167. A worm wheel 252 is fastened securely to the lower end portion of the lead screw and meshes with a worm 253 carried on one end portion of a spindle 254 journaled in the support member 167 and having a knob 255 on its opposite end portion. When the knob is turned, the worm acts through the worm wheel to turn the lead screw 251 and thereby raise or lower the plates 246 and 247 and the hold-down rail 230 relative to the rails 42 and 43. Accordingly, after the hold-down rail has been adjusted angularly by the screw 241 to establish the desired taper of the throat 231, the entire hold-down rail may be adjusted upwardly and downwardly in a linear manner by the knob 255 so as to establish the height of the throat while maintaining the desired taper. As a result, the taper and height of the throat may be established independently without need of multiple trial and error adjustments.

I claim:

1. A flat die thread rolling machine comprising a base, stationary and movable dies on said base and having opposed faces with thread forming elements extending therealong, means for reciprocating said movable die back and forth relative to said stationary die between first and second positions and along a preselected path extending in the same general direction as said thread forming elements, mechanism for feeding a fastener blank between said dies each time said movable die is in said first position, a first member supported for selective adjustment relative to said base and carrying said stationary die, a second member carrying said first member and supported for selective adjustment relative to said base along a different path than said first member, said first member and said stationary die being movable with but also being adjustable relative to said second member, a third member carrying said second member and supported for selective adjustment relative to said base along a different path than said first and second members, said first and second members and said stationary die being movable with but also being adjustable relative to said third member, said second and third members being sandwiched between said base and said first member, means for selectively adjusting said first member to different positions relative to said second member and said base, for selectively adjusting said second member to different positions relative to said third member and said base and for selectively adjusting said third member to different positions relative to said base, locking means adapted to be switched between a clamped condition for clamping said members tightly against movement relative to said base and a released condition unclamping said members for adjustment relative to said base by said adjusting means, and a reversible power-operated actuator connected to said locking means and selectively operable to switch said locking means between said clamped and released conditions, said locking means acting independently of said adjusting means and being switchable by said power-operated actuator between said clamped and released conditions without changing the adjusted position of said members on said base, said locking means comprising a plurality of rods each extending slidably through said base and said second and third members and each anchored to said first member, said actuator comprising force-applying wedge means operable to exert force on said rods in one longitudinal direction to clamp all of said members against movement relative to said base and operable to release the force on said rods to unclamp all of said members from said base.

2. A flat die thread rolling machine as defined in claim 1 in which said third member comprises a plate mounted on said base for back and forth linear adjustment along a path extending substantially parallel to said preselected path thereby to enable longitudinal alinement of the thread forming elements of said dies, said second member comprising a plate mounted on top of said third member for back and forth angular adjustment relative to said third member about an axis extending substantially perpendicular to said preselected path thereby to enable adjustment of the squeeze angle between the thread forming elements of said dies, said first member comprising a plate mounted on top of said second member for back and forth linear adjustment relative to said second member along a path extending substantially perpendicular to said preselected path thereby to enable adjustment of the transverse spacing between the thread forming elements of said dies.

3. A flat die thread rolling machine as defined in claim 1 further including abutments on said rods, said force-applying wedge means comprising wedges adapted to be forced between said abutments and said base to exert force on said rods in said one longitudinal direction.

4. A flat die thread rolling machine as defined in claim 3 in which said actuator further comprises a reciprocable rod connected to said wedges and operable when shifted in one direction to force said wedges between said abutments and said base.

* * * * *